US011077382B2

(12) United States Patent
Kvesic

(10) Patent No.: US 11,077,382 B2
(45) Date of Patent: Aug. 3, 2021

(54) WHEEL REMOVAL TOOL FOR A TOY VEHICLE WHEEL

(71) Applicant: Bruder Spielwaren GmbH + Co. KG, Fürth (DE)

(72) Inventor: Goran Kvesic, Fürth (DE)

(73) Assignee: Bruder Spielwaren GmbH + Co. KG, Fürth (DE)

( * ) Notice: Subject to any disclaimer, the term of this patent is extended or adjusted under 35 U.S.C. 154(b) by 0 days.

(21) Appl. No.: 16/741,217

(22) Filed: Jan. 13, 2020

(65) Prior Publication Data

US 2020/0222820 A1 Jul. 16, 2020

(30) Foreign Application Priority Data

Jan. 15, 2019 (DE) ..... 10 2019 200 392.3

(51) Int. Cl.
*A63H 17/00* (2006.01)
*A63H 17/26* (2006.01)

(52) U.S. Cl.
CPC ..... *A63H 17/262* (2013.01); *A63H 17/002* (2013.01)

(58) Field of Classification Search
CPC ..... A63H 17/262; A63H 17/002
USPC ..... 301/111.01–111.07; 29/426.5–426.6, 261
See application file for complete search history.

(56) References Cited

U.S. PATENT DOCUMENTS 277,425 A * 5/1883 Patterson ..... B60B 37/10 301/120
1,465,467 A * 8/1923 Erickson ..... B25B 27/023 29/261
1,485,733 A * 3/1924 Sterling et al. ..... B25B 27/023 29/261
1,668,688 A * 5/1928 Mason ..... B25B 27/02 29/262
1,975,773 A * 10/1934 Davis ..... B60B 29/001 29/273
2,049,489 A * 8/1936 Christen ..... B25B 27/0042 29/245

(Continued)

FOREIGN PATENT DOCUMENTS

DE 1730029 U 9/1956
DE 3302826 A1 10/1984

(Continued)

*Primary Examiner* — Eugene L Kim
*Assistant Examiner* — Matthew B Stanczak
(74) *Attorney, Agent, or Firm* — Smartpat PLC

(57) ABSTRACT

A wheel removal tool for a toy vehicle wheel has a tool base body and at least one rear-engagement portion. The latter is connected fixedly to the tool base body and is embodied so that it, in a removal starting position, engages behind an assigned removal portion of the toy vehicle wheel. A removal lever of the removal tool has a supporting portion for support on a vehicle component fixed on the chassis. The removal lever is adjustable relative to the tool base body between the removal starting position and a removal end position. In the latter, the at least one rear-engagement portion is displaced relative to the supporting portion in a removal direction. This results in a removal tool with which a simple detachment, which is in particular close to reality, of the toy vehicle wheel from a chassis-side vehicle component is enabled.

11 Claims, 9 Drawing Sheets

(56) References Cited

U.S. PATENT DOCUMENTS 2,113,408 A * 4/1938 Nelson ..... B60B 29/001 29/245
2,778,159 A * 1/1957 Irwin ..... A63H 17/262 446/465
2,837,815 A * 6/1958 Schumann ..... B60B 27/0026 29/267
3,689,978 A * 9/1972 Kelso ..... B25B 27/023 29/259
3,826,471 A * 7/1974 Orton ..... F41B 5/14 254/131
4,193,639 A * 3/1980 Pauly ..... A63H 17/262 301/35.61
4,299,051 A * 11/1981 Pauly ..... A63H 17/262 301/118
4,398,706 A * 8/1983 Kaulfuss ..... B25B 5/103 269/156
4,606,106 A * 8/1986 Dutton ..... B25B 27/0028 29/235
4,900,095 A * 2/1990 Brubaker ..... A63H 17/262 152/396
4,908,925 A * 3/1990 Johnson ..... B25B 27/023 29/244
4,963,115 A * 10/1990 Stowell ..... A63H 17/262 280/103
5,896,639 A * 4/1999 Chen ..... B25B 27/026 29/261
5,902,018 A * 5/1999 Owen ..... B60B 37/10 301/111.04
6,170,920 B1 * 1/2001 Markling ..... B60B 5/02 301/111.01
6,266,861 B1 * 7/2001 Chen ..... B25B 27/064 29/252
6,523,910 B1 * 2/2003 Lin ..... B60B 37/10 301/111.06
6,581,265 B2 * 6/2003 Sawaya ..... B25B 27/023 29/239
6,945,840 B2 * 9/2005 Hui ..... A63H 17/262 446/465
8,590,984 B2 * 11/2013 Morris ..... B60B 37/10 301/111.03
8,944,524 B1 * 2/2015 Sheefel ..... B60B 37/10 301/121
9,610,514 B2 * 4/2017 Mizunaga ..... B60B 3/045
10,137,730 B2 * 11/2018 Liukas ..... B25B 27/0028
2002/0036427 A1 * 3/2002 Melgarejo ..... B60B 37/10 301/111.06
2003/0003842 A1 * 1/2003 Edmisson ..... A63H 17/262 446/465
2003/0037425 A1 * 2/2003 Sawaya ..... B60B 29/008 29/426.5
2003/0117009 A1 * 6/2003 Flood ..... B65F 1/1473 301/111.01
2003/0234572 A1 * 12/2003 Flood ..... B60B 37/10 301/111.03
2005/0145313 A1 * 7/2005 Yokobori ..... B60C 11/02 152/209.5
2007/0164601 A1 * 7/2007 Mercier ..... B60B 37/10 301/121
2008/0261488 A1 * 10/2008 Jabbour ..... B60B 3/001 446/466
2010/0237686 A1 * 9/2010 Wang ..... A63H 17/262 301/53.5
2012/0074663 A1 * 3/2012 Parker ..... B65F 1/1473 280/29
2012/0208429 A1 * 8/2012 Sheridan ..... A63H 17/262 446/466
2012/0252314 A1 * 10/2012 Milne ..... A63H 17/262 446/465
2013/0305510 A1 * 11/2013 Eastman ..... B60B 29/008 29/426.5
2015/0143692 A1 * 5/2015 James ..... B60B 29/008 29/802
2015/0265935 A1 * 9/2015 Hoe ..... A63H 17/262 446/465
2016/0038845 A1 * 2/2016 Mizunaga ..... B60B 3/001 446/431
2017/0203222 A1 * 7/2017 Bruder ..... B60B 37/10
2020/0222820 A1 * 7/2020 Kvesic ..... A63H 17/262
2020/0247179 A1 * 8/2020 Christensen ..... B60B 7/063

FOREIGN PATENT DOCUMENTS

DE 3347791 A1 10/1984
EP 3192575 A1 7/2017

* cited by examiner

WHEEL REMOVAL TOOL FOR A TOY VEHICLE WHEEL

CROSS-REFERENCE TO RELATED APPLICATIONS

This application claims the priority of German Patent Application, Serial No. DE 10 2019 200 392.3, filed on Jan. 15, 2019, pursuant to 35 U.S.C. 119(a)-(d), the content of which is incorporated herein by reference in its entirety as if fully set forth herein.

TECHNICAL FIELD

The invention relates to a wheel removal tool for a toy vehicle wheel.

BACKGROUND

DE 33 02 826 A1 discloses a toy vehicle with axle stubs with a slit and undercut into which in each case a wheel is pushed as well as a removal device for this purpose. DE 33 47 791 A1 discloses a device for removing and mounting a toy wheel.

In the case of toy vehicles, wheels are often connected to chassis-side vehicle components by pushing on with interference fit. In particular if the intention is to play a game where the wheel is changed, the detachment of the wheel from the chassis-side vehicle component is, among other things, difficult and is furthermore not based on the real example as is desired if the wheel is simply manually removed.

SUMMARY

One object of the present invention is therefore to enable a simple detachment, which is in particular close to reality, of a toy vehicle wheel from a chassis-side vehicle component.

This object is achieved by a wheel removal tool for a toy vehicle wheel, with a tool base body, with at least one rear-engagement portion which is connected fixedly to the tool base body and is embodied so that the at least one rear-engagement portion, in a removal starting position, engages an assigned removal portion of the toy vehicle wheel from behind, with a removal lever which has a supporting portion for supporting the removal lever on a vehicle component fixed on the chassis, wherein the removal lever is adjustable relative to the tool base body between the removal starting position and a removal end position in which, compared with the removal starting position, the at least one rear-engagement portion is displaced relative to the supporting portion in a removal direction.

The wheel is detached from the chassis-side vehicle component with the wheel removal tool via a lever action of a removal lever which is an integral component of the wheel removal tool. This produces a simple detachment even of a solidly fitted toy vehicle wheel which is furthermore based more closely on the real example by using a tool. The wheel removal tool can be manufactured from plastic. The wheel removal tool can be manufactured as an injection moulded part. The wheel removal tool can comprise exactly two components which are connected movably to one another, namely the tool base body and the removal lever. A removal force can be predefined over a length of an actuating portion of the removal lever.

Several rear-engagement portions are tried and tested in the secure removal of the toy vehicle wheel. The wheel removal tool can have two to, for example, eight rear-engagement portions, e.g. five rear-engagement portions. The number of rear-engagement portions can be adapted to a rim design of the toy vehicle wheel.

A distributed arrangement of the rear-engagement portions, as seen in a projection perpendicular to the removal direction, around the supporting portion, leads to a uniform introduction of force from the wheel removal tool onto the toy vehicle wheel during removal. The rear-engagement portions can, as seen in projection perpendicular to the removal direction, be arranged distributed in a statically stable manner around the supporting portion. The rear-engagement portions can, as seen in this projection, be arranged distributed evenly around the supporting portion or also unevenly distributed around the supporting portion.

In the case of the engagement of the at least one rear engagement portion behind the removal portion of the toy vehicle wheel in the circumferential direction around the removal direction, a pivoting displacement of the wheel removal tool between a tool introduction position, in which the at least one rear-engagement portion is still not in engagement with the assigned removal portion of the toy vehicle wheel, and the removal starting position, in which the at least one rear-engagement portion engages behind the assigned removal portion of the toy vehicle wheel, is possible. This enables a simultaneously simple configuration of the wheel removal tool and also easy operation of the wheel removal tool.

A configuration of the supporting portion of the removal lever as a supporting surface at a free end of the removal lever is structurally simple.

The same applies to a pivotable configuration of the removal lever on the tool base body about a removal pivot axis.

A configuration of the wheel removal tool, wherein the rear-engagement portions are arranged in a rear-engagement plane of the wheel removal tool, wherein the removal pivot axis is arranged parallel to the rear-engagement plane, is kinematically expedient.

The advantages of a toy vehicle set with a toy vehicle and a wheel removal tool correspond to those which have already been explained above with reference to the wheel removal tool.

A counter-supporting end face of an axle unit of the toy vehicle, which is used as a chassis-side vehicle component, which is embodied to support the supporting portion of the removal lever, to support the removal tool, represents a variant which is structurally easy to realize.

The components of the toy vehicle set, in particular a wheel assembly of the toy vehicle, can be manufactured overall from plastic. These plastic components can be manufactured as injection moulded parts.

An exemplary embodiment of the invention is explained in greater detail below on the basis of the drawings.

DETAILED DESCRIPTION

Figure 1:
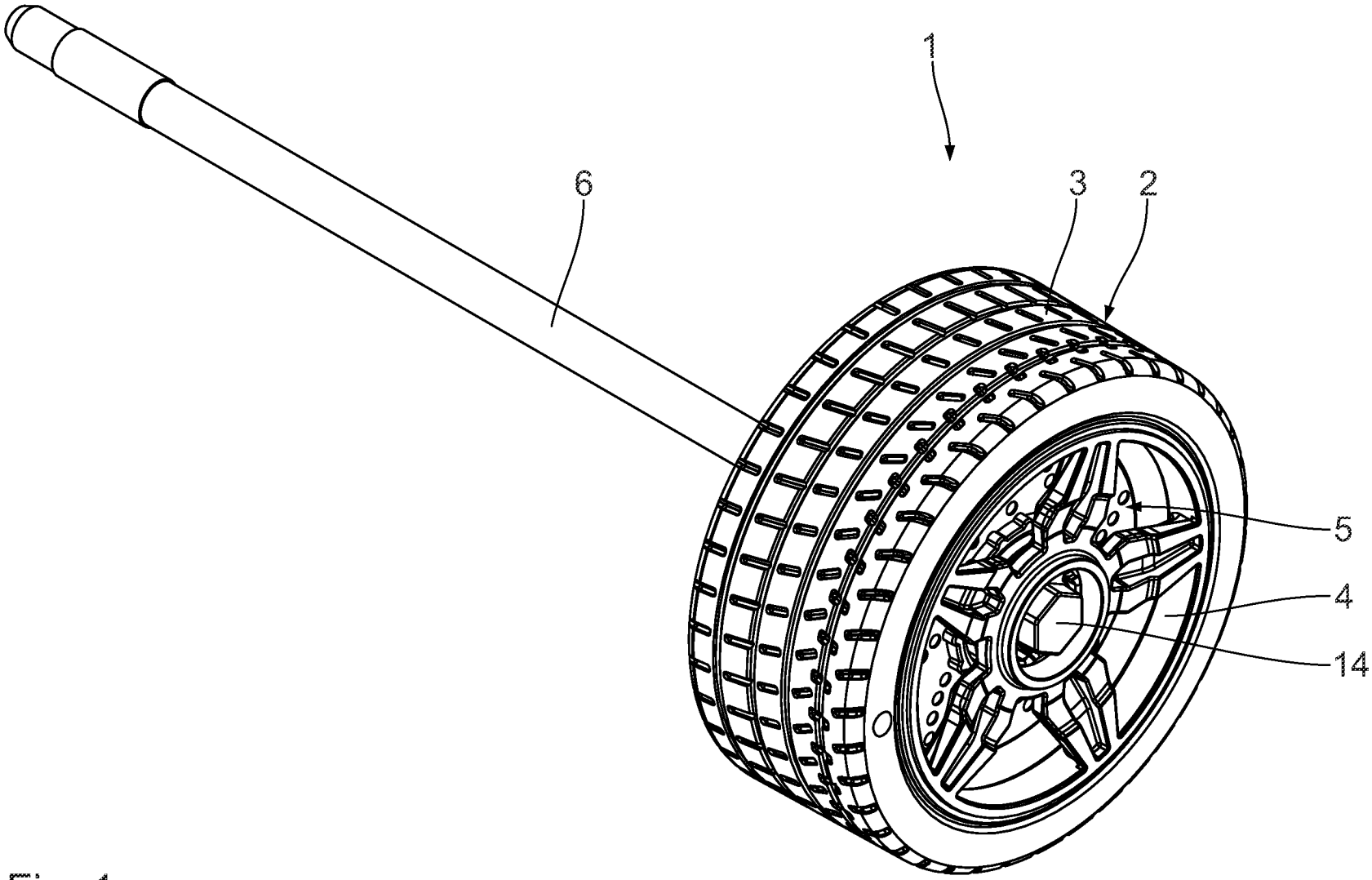
FIG. 1 shows in perspective a wheel assembly of a toy vehicle with a toy vehicle wheel and an axle which passes between a pair of wheels of the toy vehicle.

A wheel assembly 1 represented in FIG. 1 has a toy vehicle wheel 2 for a toy vehicle which is not otherwise represented. The wheel 2 has a tyre 3, a rim 4 and a disc brake component 5 (cf. in particular FIG. 2). The wheel assembly 1 furthermore includes an axle 6 which passes between a pair of wheels of the toy vehicle.

Figure 5:
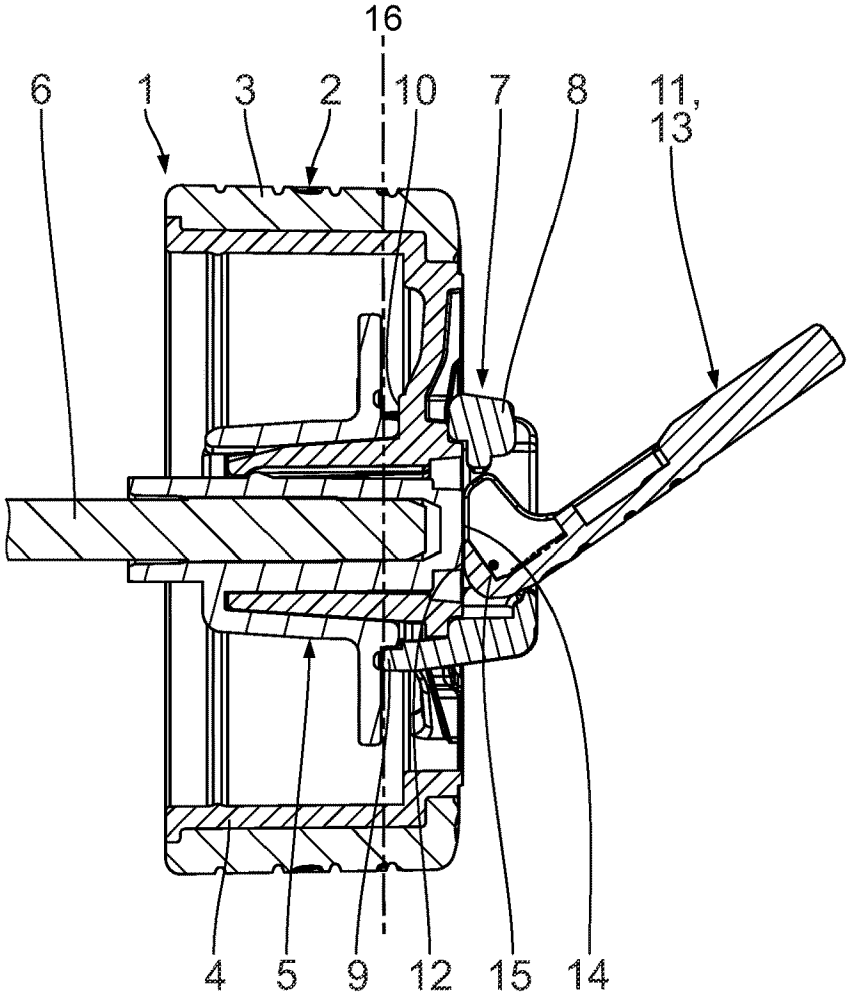
FIG. 5 shows a section according to line V-V in FIG. 4.

It can be inferred from the axial section according to FIG. 5 that the disc brake component 5 is pushed on at the end side with interference fit onto the axle 6, wherein in turn the rim 4 of the wheel 2 is pushed onto an axle-side end portion of the disc brake component 5 with interference fit.

Figure 2:
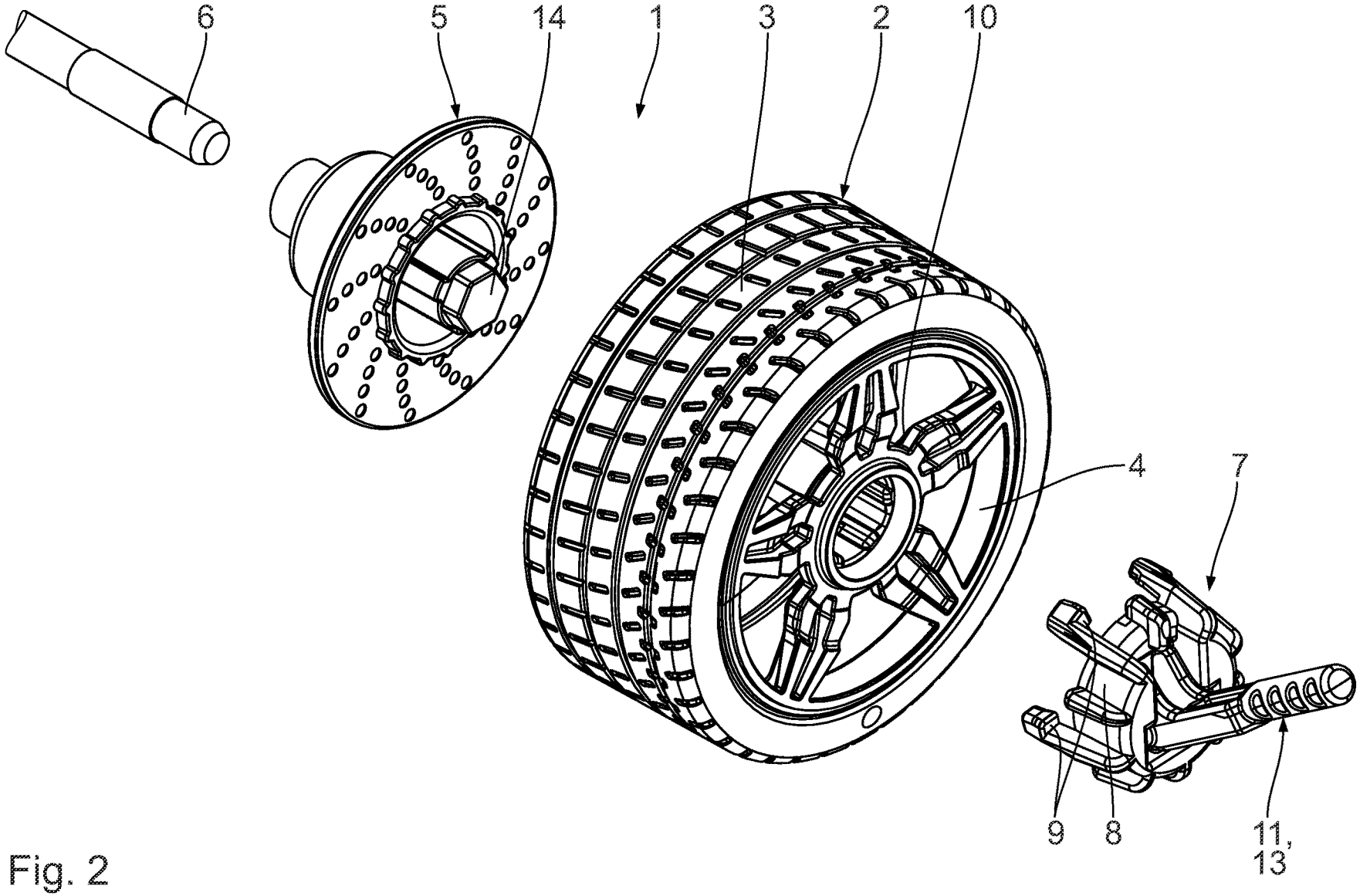
FIG. 2 shows an exploded representation of the wheel assembly according to FIG. 1, wherein a disc brake component of the wheel assembly is additionally visible and a wheel removal tool for the wheel is also additionally represented.

A wheel removal tool 7 serves to remove the wheel 2 from the associated free end of the axle 6 (cf. e.g. FIG. 2).

The wheel removal tool 7 has a tool base body 8 on which a total of five rear rear-engagement portions 9 are formed in each case in one piece. Each of rear-engagement portions 9 is formed to engage behind an assigned removal portion 10 of the wheel 2, namely to engage behind in each case one of the five spokes of the rim 4. The rear-engagement portions 9 are fixedly connected to the tool base body 8.

The wheel removal tool 7 furthermore has a removal lever 11. The latter has (cf. e.g. FIG. 5) a supporting portion 12 at a free lever end and an actuating portion 13 at the other free lever end. The supporting portion 12 serves to support the removal lever 11 at a chassis-side vehicle component, namely at a counter-supporting end face 14 of the wheel assembly 1. The counter-supporting end face 14 is part of the disc brake component 5. Alternatively, e.g. an end face of the axle 6 can also be used as the counter-supporting end face 14.

Figure 4:
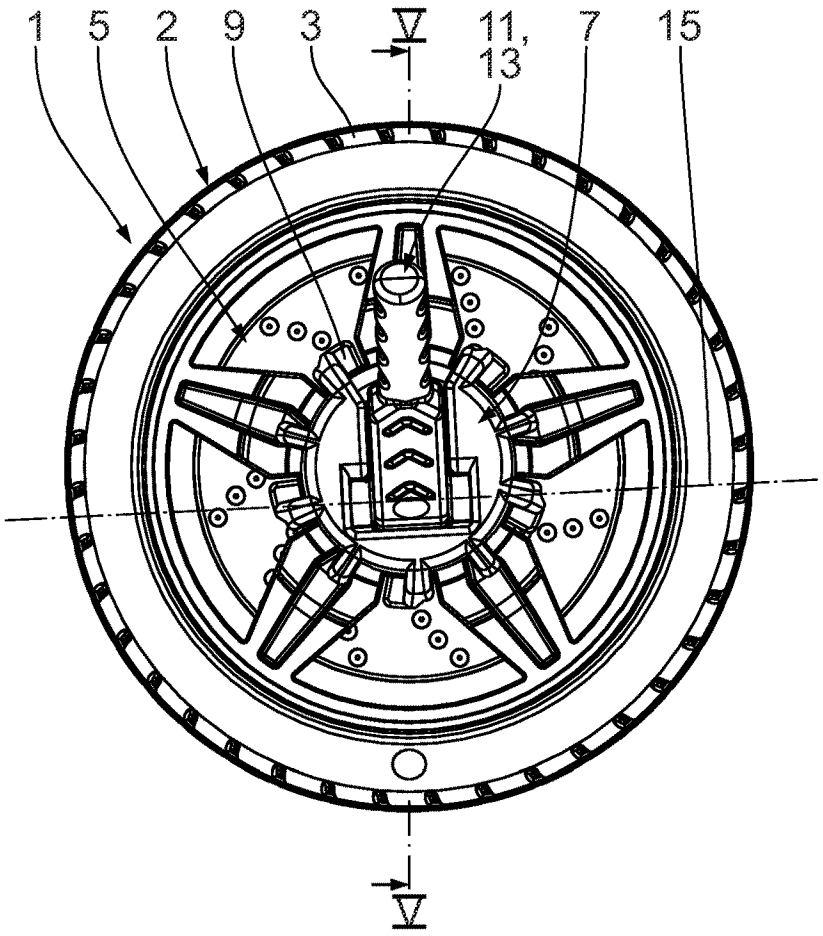
FIG. 4 shows a top view of the wheel assembly with the wheel removal tool in the tool introduction position.
Figure 6:
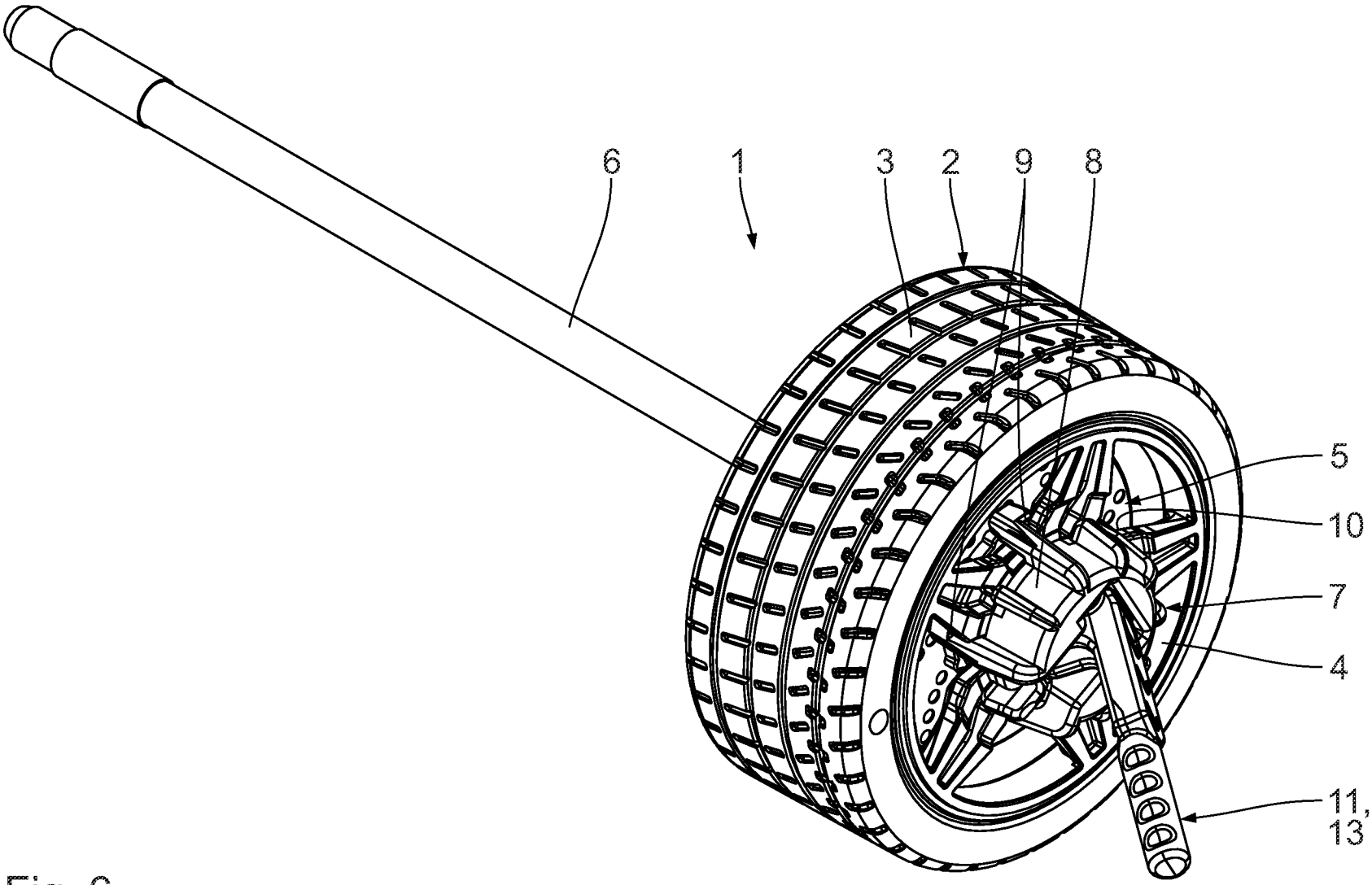
FIG. 6 shows, in a similar position to FIG. 3, the wheel assembly with the wheel removal tool in a removal starting position which is pivoted in a clockwise direction relative to the wheel in comparison with the tool introduction position according to FIG. 3.
Figure 7:
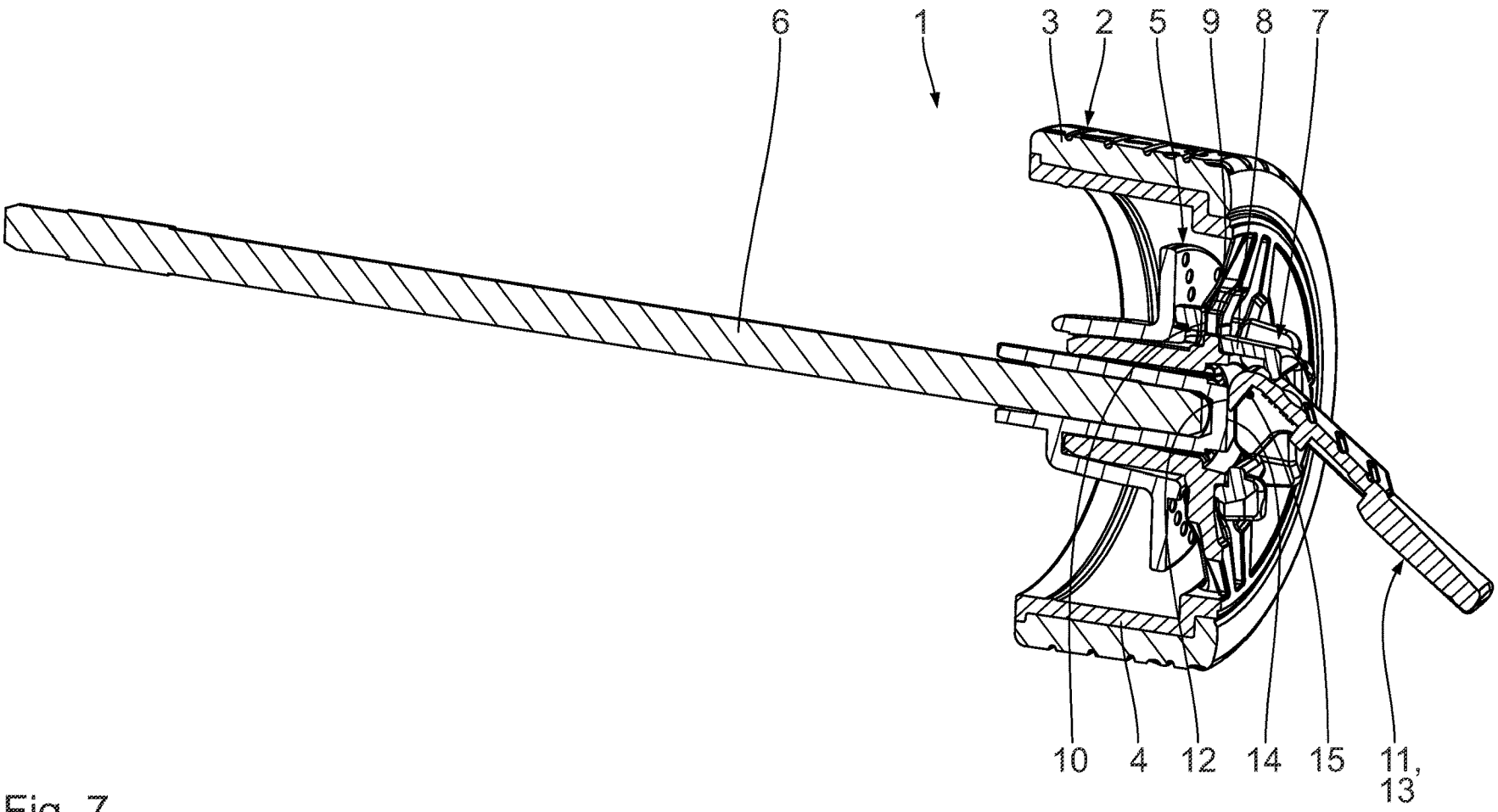
FIG. 7 shows an axial section through the wheel assembly with the wheel removal tool in the removal starting position.
Figure 10:
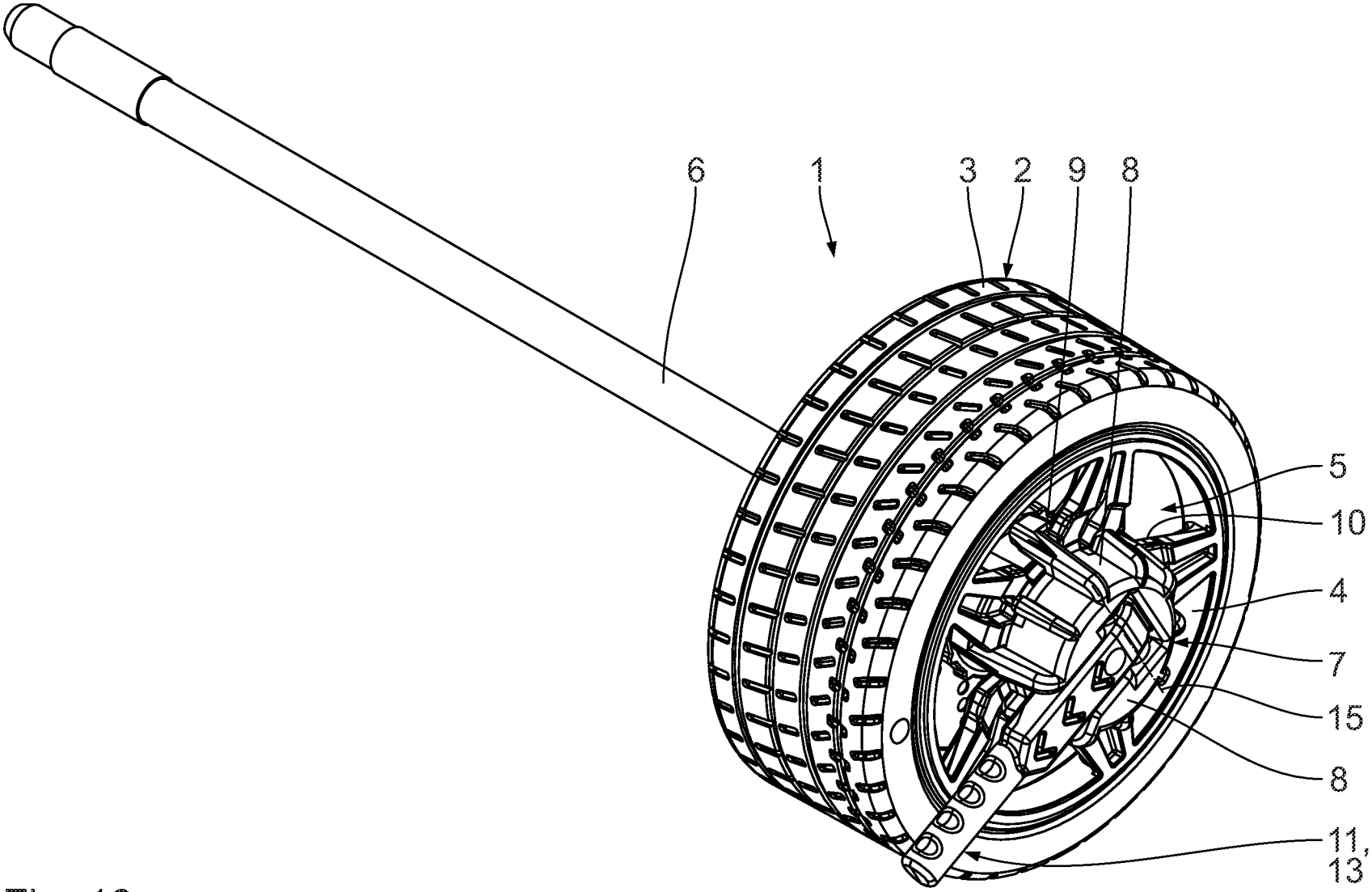
FIG. 10 shows, in a view similar to FIG. 3, the wheel assembly with the wheel removal tool in a removal end position.

The removal lever 11 is mounted pivotably on the tool base body 8 of the wheel removal tool 7 about a removal pivot axis 15 (cf. e.g. FIGS. 4, 5 and 10).

Figure 9:
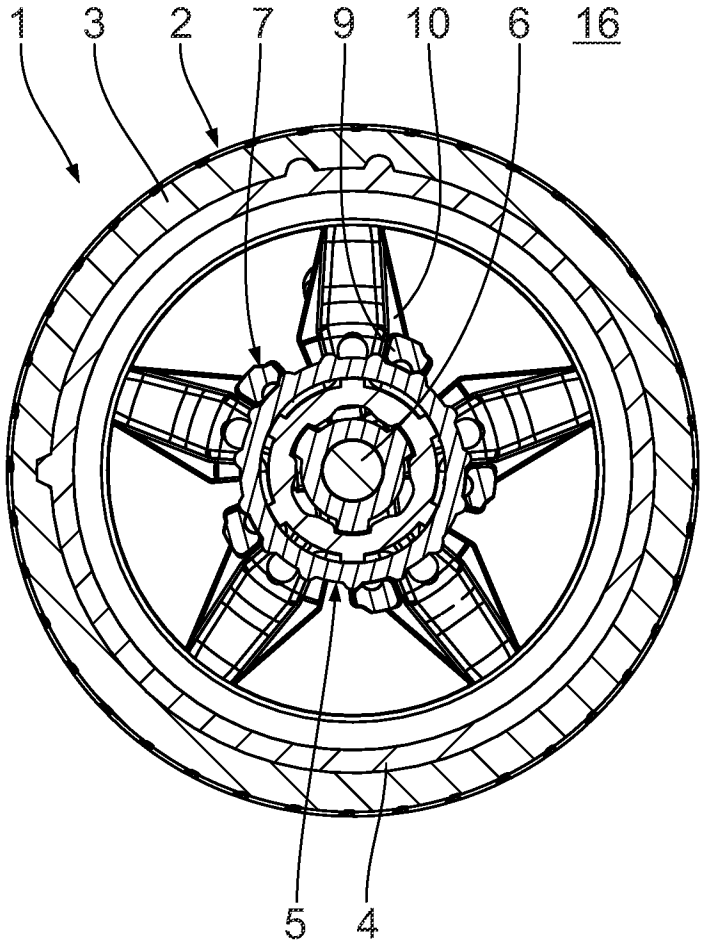
FIG. 9 shows a section according to line IX-IX in FIG. 8.
Figure 8:
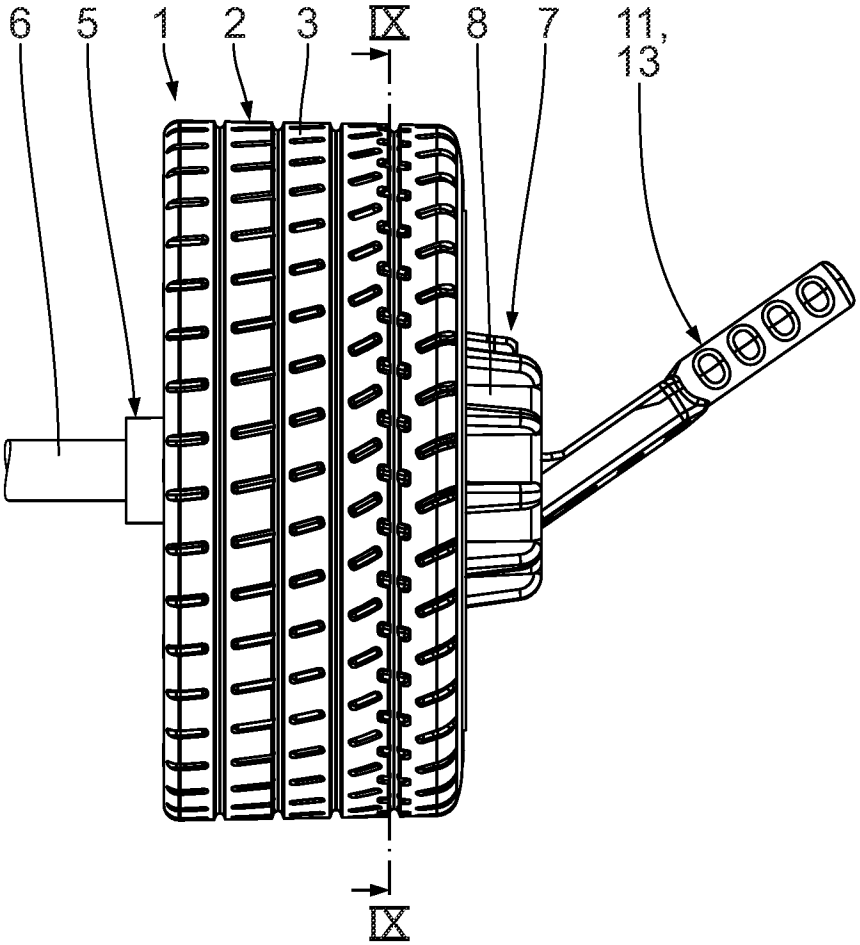
FIG. 8 shows a side view of the wheel assembly with the wheel removal tool in the removal starting position.

The rear-engagement portions 9 are arranged in a rear-engagement plane 16 which is selected as the sectional plane of FIG. 9. The removal pivot axis 15 runs parallel to the rear-engagement plane 16.

Figure 3:
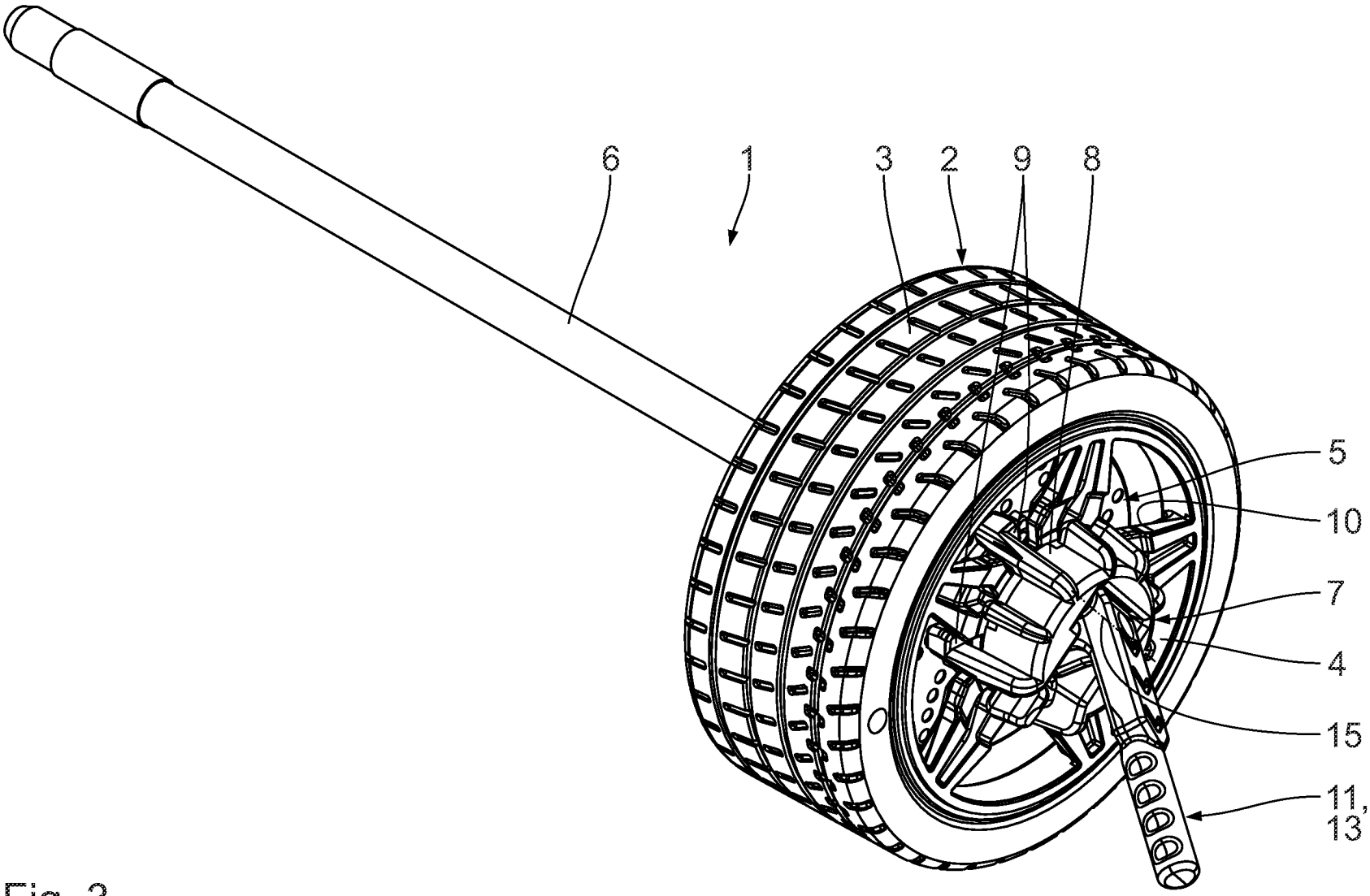
FIG. 3 shows the wheel assembly with the wheel removal tool in a tool introduction position.

FIGS. 3 to 5 show the wheel removal tool 7 relative to the rim 4 in a tool introduction position, in the case of which the rear-engagement portions 9 do not engage behind the removal portions 10, so that the axial introduction of the rear-engagement portions 9 between the spokes of the rim 4 is enabled.

FIGS. 6 to 9 show the wheel removal tool 7 relative to the rim 4 of the wheel assembly 1 in a removal starting position in which the rear-engagement portions 9 engage behind the removal portions 10 of the wheel 2. In the removal starting position, the supporting portion 12 of the removal lever 11 bears against the counter-supporting end face 14 of the wheel 2.

In comparison with the tool introduction position, the wheel removal tool 7, in the removal starting position, is displaced in the clockwise direction by approximately 10° to 20° about the axle 6.

Figure 11:
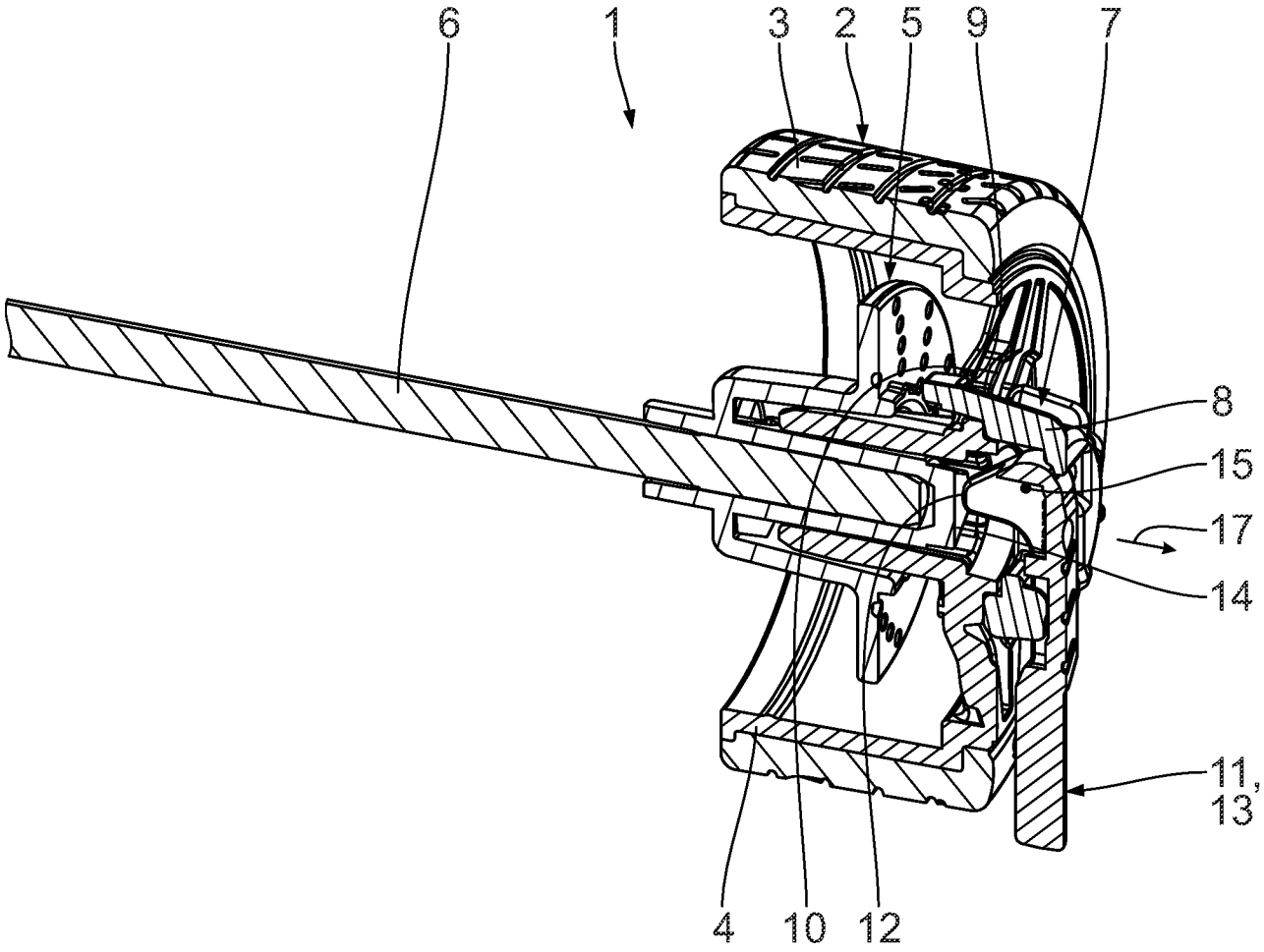
FIG. 11 shows the wheel assembly with the wheel removal tool in the removal end position, overall in an axial section.

FIGS. 10 and 11 show the wheel removal tool 7 in the removal end position. In this position, compared with the removal starting position, the rear-engagement portions 9 are displaced relative to the supporting portion 12 in a removal direction 17, i.e. away from the free end of the axle 6. As a result of the rear engagement of the rear-engagement portions 9 behind the removal portions 10 of the wheel 2, the wheel removal tool 7 entrains the wheel 2 during displacement from the removal starting position into the removal end position so that the wheel 2 comes free axially from the disc brake component 5 and in particular from the axle 6.

The rear-engagement portions 9 are (cf. FIG. 9), as seen in a projection perpendicular to the removal direction 17, arranged distributed evenly around the supporting portion 12.

The removal direction 17 runs in the direction of the axle 6.

When transferring the wheel removal tool 7 from the removal starting position into the removal end position, the actuating portion 13 is pushed down in the direction of the rim 4 of the wheel 2 and the supporting portion 12 exerts a supporting force on the counter-supporting end face 14, which supporting force is transmitted via the pivot bearing of the removal lever 11 to the base body 8 and the rear-engagement portions 9 as a removal force on the removal portions 10 of the rim 4.

The wheel assembly 1 is overall manufactured from plastic. The components of the wheel assembly 1 are embodied as injection moulded components.

The wheel removal tool 7 is manufactured from plastic. The components of the wheel removal tool 7, namely the base body 8 and the removal lever 11, are in each case an injection moulded part.

What is claimed is:

1. A wheel removal tool for a toy vehicle wheel, with a tool base body, with at least one rear-engagement portion which is connected fixedly to the tool base body and is embodied so that the at least one rear-engagement portion, in a removal starting position, engages an assigned removal portion of the toy vehicle wheel from behind, with a removal lever which has a supporting portion for supporting the removal lever on a vehicle component fixed on a chassis, wherein the removal lever is pivotable relative to the tool base body between the removal starting position and a removal end position in which, compared with the removal starting position, the at least one rear-engagement portion is displaced relative to the supporting portion in a removal direction, wherein the supporting portion serves to support the removal lever at a counter-supporting end face of the vehicle component fixed on the chassis and is pivotable between the removal starting position and the removal end position to remove the toy vehicle wheel, and wherein the counter-supporting end face is part of a disc brake component of the toy vehicle wheel.

2. The wheel removal tool according to claim 1, comprising a multiplicity of rear-engagement portions.

3. The wheel removal tool according to claim 2, wherein the rear-engagement portions, as seen in a projection perpendicular to the removal direction, are arranged distributed around the supporting portion.

4. The wheel removal tool according to claim 2, wherein the rear-engagement portions are arranged in a rear-engagement plane of the wheel removal tool, and wherein a removal pivot axis is arranged parallel to the rear-engagement plane.

5. The wheel removal tool according to claim 1, wherein the at least one rear-engagement portion is embodied so that it engages behind the removal portion of the toy vehicle wheel in a circumferential direction around the removal direction.

6. The wheel removal tool according to claim 1, wherein the supporting portion of the removal lever is embodied as a supporting surface at a free end of the removal lever.

7. The wheel removal tool according to claim 1, wherein the removal lever is mounted pivotably on the tool base body about a removal pivot axis.

8. The wheel removal tool according to claim 1, wherein the counter-supporting end face is formed by an end face of a wheel assembly axle.

9. The wheel removal tool according to claim 1, wherein the supporting portion is cam-shaped.

10. A toy vehicle set, comprising:

a toy vehicle having a toy vehicle wheel; and a wheel removal tool with a tool base body, with at least one rear-engagement portion which is connected fixedly to the tool base body and is embodied so that the at least one rear-engagement portion, in a removal starting position, engages an assigned removal portion of the toy vehicle wheel from behind, with a removal lever which has a supporting portion for supporting the removal lever on a vehicle component fixed on a chassis, wherein the removal lever is pivotable relative to the tool base body between the removal starting position and a removal end position in which, compared with the removal starting position, the at least one rear-engagement portion is displaced relative to the supporting portion in a removal direction, wherein the supporting portion serves to support the removal lever at a counter-supporting end face of the vehicle component fixed on the chassis and is pivotable between the removal starting position and the removal end position to remove the toy vehicle wheel, wherein the vehicle component fixed on the chassis, which is embodied to support the supporting portion of the removal lever, represents a counter-supporting end face of an axle unit of the toy vehicle, and wherein the axle unit has a continuous axle and disc brake components pushed onto free ends of the continuous axle on wheel sides thereof, wherein the counter-supporting end face is part of the disc brake components.

11. A wheel removal tool for a toy vehicle wheel, comprising:

a tool base body with a rear-engagement portion integrally formed on the tool base body and configured to engage, in a removal starting position, behind the toy vehicle wheel; and a removal lever pivotably mounted on the tool base body, the removal lever having a cam surface for supporting the removal lever on an end face of an axle, wherein the removal lever is pivotable between the removal starting position and a removal end position, and wherein the cam surface pushes against the end face of the axle when the removal lever is pivoted from the removal starting position to the removal end position while the removal tool pulls the toy vehicle wheel off the axle, and wherein the end face of the axle is formed by a disc brake component arranged at the end of the axle.

* * * * *